United States Patent [19]

Pugh

[11] Patent Number: 5,016,376

[45] Date of Patent: May 21, 1991

[54] MAGNETIC ACTUATED FIREARMS LOCKING MECHANISM

[76] Inventor: Kenneth J. Pugh, 5326 Spanish Oak, Houston, Tex. 77066

[21] Appl. No.: 424,541

[22] Filed: Oct. 20, 1989

[51] Int. Cl.[5] ..... F41A 17/06

[52] U.S. Cl. ..... 42/70.11; 42/70.06; 42/70.08

[58] Field of Search ..... 42/70.01, 70.11, 70.06, 42/70.08, 66

[56] References Cited

U.S. PATENT DOCUMENTS

| | | | |
|---|---|---|---|
| 2,979,845 | 4/1961 | Christiansen | 42/70.06 |
| 3,978,604 | 9/1976 | Smith | 42/70.06 |
| 4,003,152 | 1/1977 | Baker et al. | 42/70.01 |
| 4,067,132 | 1/1978 | Smith | 42/66 |
| 4,110,928 | 9/1978 | Smith | 42/66 |
| 4,135,320 | 1/1979 | Smith | 42/70.01 |
| 4,154,014 | 5/1979 | Smith | 42/70.06 |
| 4,457,091 | 7/1984 | Wallerstein | 42/70.11 |
| 4,467,545 | 8/1984 | Shaw | 42/70.01 |
| 4,488,370 | 12/1984 | Lemelson | 42/70.01 |
| 4,563,827 | 1/1986 | Heltzel | 42/70.01 |
| 4,682,435 | 7/1987 | Heltzel | 42/70.01 |
| 4,763,431 | 8/1988 | Allan et al. | 42/70.11 |

*Primary Examiner*—Michael J. Carone

*Attorney, Agent, or Firm*—Marsteller & Associates

[57] ABSTRACT

This invention teaches a safety for preventing unauthorized firing of a weapon (H) of the type having a trigger (19) and mechanical firing mechanism (21) for firing the weapon. A solenoid (S) controllably actuates or deactuates upon the application of an electrical signal. A decoder (D) is mounted with the weapon for detecting a signal from an authorized user and selectively activating the solenoid upon the signal from the authorized user. Such decoder (D) is electrically connected to at least a power source (P) and to the solenoid (S). An encoder (E) creates the signal indicating that the possessor is authorized to use the weapon. A linkage (L) connects the solenoid (S) and the firing mechanism (F) for controllably enabling or disabling the weapon from being fired upon the desired activation of the solenoid.

29 Claims, 2 Drawing Sheets

MAGNETIC ACTUATED FIREARMS LOCKING MECHANISM

BACKGROUND OF THE INVENTION

1. Technical Field.

This invention relates generally to a firearm locking or safety mechanisms, and more particularly to the use of a magnetic ring or strip held by the operator of a firearm actuating a solenoid linked to a mechanism to secure the firing means in the firearm.

2. Background Art.

One problem an owner of firearms often encounters is preventing the unauthorized use of the weapon. An example of such unauthorized use is a criminal's shooting a handgun wrested from a police officer during a scuffle. Another unauthorized use is a child shooting a parent's weapon kept in the house.

A typical handgun or rifle includes a "safety." Often the safety is a slide or switch that uses a mechanical linkage to disable or lock the internal firing mechanism of the weapon. Such a safety mechanism normally protects only against unintended use, such as preventing the weapon from firing if the weapon is dropped. A problem with the mechanical switch is that anyone can disable such a safety mechanism.

Several safety systems for weapons have been invented and patented. Christiansen (U.S. Pat. No. 2,979,845) discloses a firearm including a solenoid connected by contacts to release a safety mechanism to permit operation of the weapon. Physical contact of the electrical contacts must be made to actuate the solenoid.

Several other mechanical safety devises have been disclosed. Smith (U.S. Pat. Nos. 3,978,604, 4,067,132, 4,110,928, 4,135,320, and 4,154,014) teaches a variety of mechanical safety devices for firearms actuated by a magnetic ring worn by the operator of the firearm. However, the Smith references disclose a device that does not distinguish among any magnetic source so long as the strength of the magnet is sufficient to attract the magnetically responsive bar.

DISCLOSURE OF INVENTION

It is an object of this invention to provide a solenoid operated safety or locking mechanism that uses an encoder and a decoder means to selectively operate the safety.

It is another object of this invention to provide an encoder and decoder means generally adaptable to controllably operate locking mechanisms in general.

A further objective of this invention is to provide a weapon that can easily determine whether a user is authorized and if not, then it disables the weapon such that the unauthorized use is prevented.

This invention provides a safety device for preventing unauthorized firing of a weapon of the type having a trigger and known mechanical firing means for firing the weapon. A solenoid means controllably actuates or deactuates upon the application of an electrical signal generated by a power source such as a battery. A decoder means is mounted with the weapon for detecting a signal from an authorized user and selectively activating the solenoid means upon the signal from the authorized user. Such decoder means is electrically connected to at least the power source and to the solenoid means. The user of the weapon generally wears an encoder means that creates the signal indicating that the possessor is authorized to use the weapon. Linkage means connects the solenoid means and the firing means for controllably enabling or disabling the weapon from being fired upon the desired activation of the solenoid means.

MODE(S) FOR CARRYING OUT THE INVENTION

A simple, efficient device is provided as a safety mechanism to prevent accidental or unauthorized firing of a weapon. The device is relatively foolproof in requiring the user to have an encoding device before the firing mechanism can be actuated.

So that the manner in which the above recited features, advantages and objects of the present invention are attained can be understood in detail, more particular description of the invention, briefly summarized above, may be had by reference to the embodiment thereof which is illustrated in the appended drawings. In all the drawings, identical numbers represent same elements.

Figure 1:
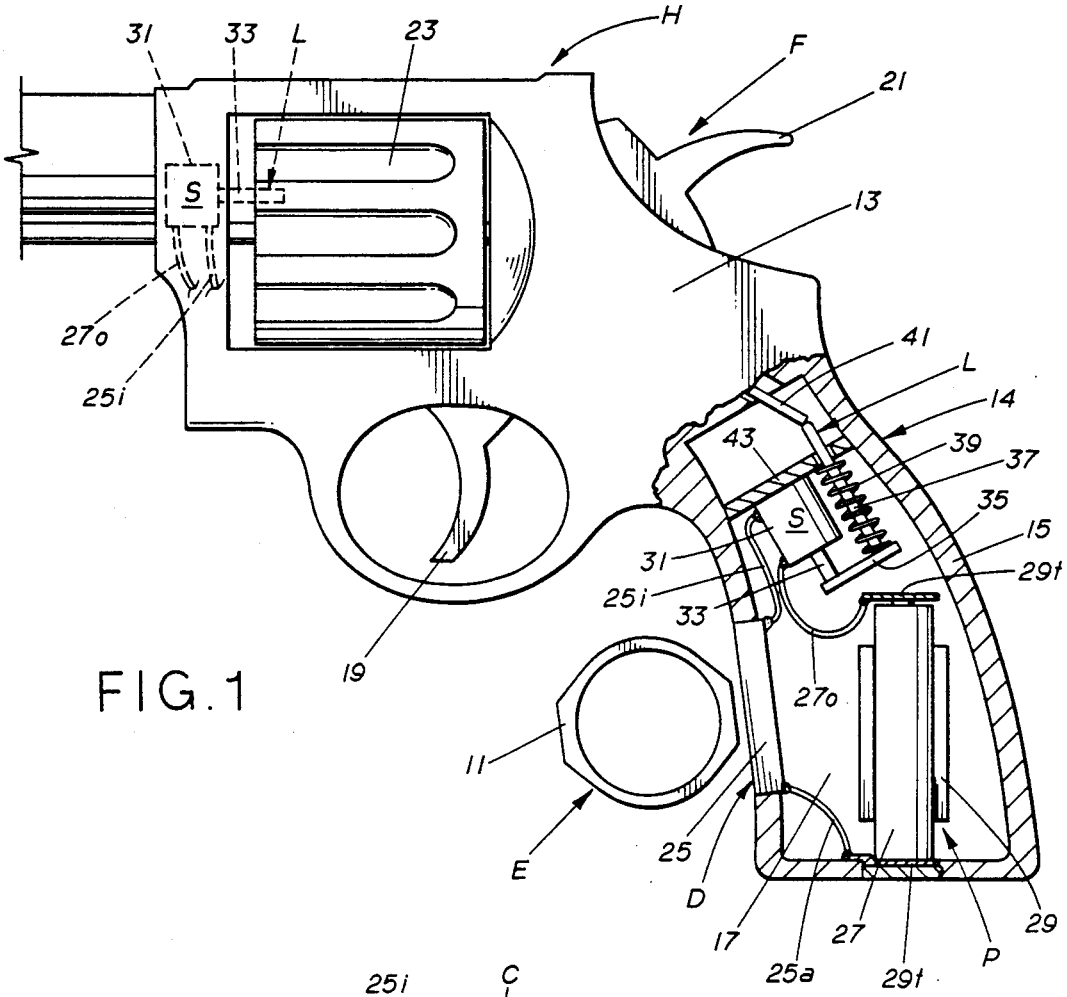
FIG. 1 is a side view of a known revolver-type handgun having a cut-away view of the interior of the handle with the present invention mounted therein. In phantom is an alternative embodiment for the solenoid and linking mechanism in a revolver type weapon.

Referring now to FIG. 1, the present invention generally is a safety device for preventing unauthorized firing of a weapon (H) of the type having a trigger (19) and known mechanical firing means (F) for firing the weapon. A solenoid means (S) controllably actuates or deactuates upon the application of an electrical current or signal generated by the power source (P). A decoder means (D) is mounted with the weapon for detecting a signal from an authorized user and selectively activating the solenoid means upon the signal from the authorized user. Such decoder means (D) is electrically connected to at least a power source (P) and to the solenoid means (S). An encoder means (E) creates the signal indicating that the possessor is authorized to use the weapon. Linkage means (L) connects the solenoid means (S) and the firing means (F) for controllably enabling or disabling the weapon from being fired upon the desired activation of the solenoid means.

Figure 3:
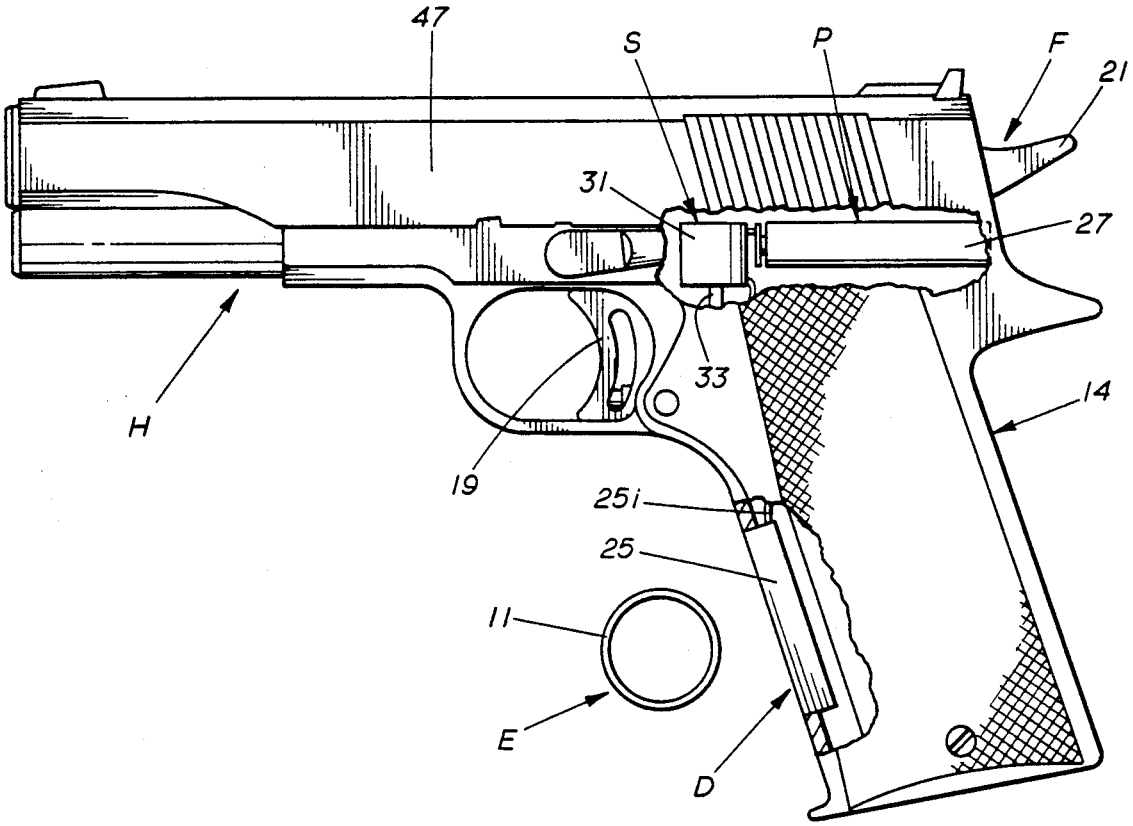
FIG. 3 is a side view of a known automatic-type handgun having a cut-away view of the interior of the handle with the present invention mounted therein.

There are many known types of weapons. FIG. 1 depicts a typical handgun or pistol (H) of the revolver type (13) having a revolving cylinder or chamber (23) containing cartridges. FIG. 3 discloses a handgun (H) typically called an automatic (47). Another typical or known type of weapon is a rifle or shotgun, both of which are shoulder mountable. Other known weapons adaptable for use with the present invention are shoulder mounted rocket launchers and bazookas.

Each of these weapons (H) generally include a handle (14), trigger (19), and firing mechanisms (generally represented as F). The several patents referenced above disclose and depict the details of the known types of mechanical firing mechanisms linking the triggers and the specific members firing the cartridge or rocket from the weapon.

With particular reference to FIG. 1, a decoder means (D) is mounted with the weapon (H). The decoder detects a signal indicating an authorized user, such as a magnetic field (45). Upon the decoder's determination that the signal is from an authorized user, the decoder (D) selectively activates the solenoid means (S), such as by completing an electrical circuit (C). The decoder (D) is in the electrical circuit (C) that further includes at least a power source (P) and the solenoid (S).

Figure 2:
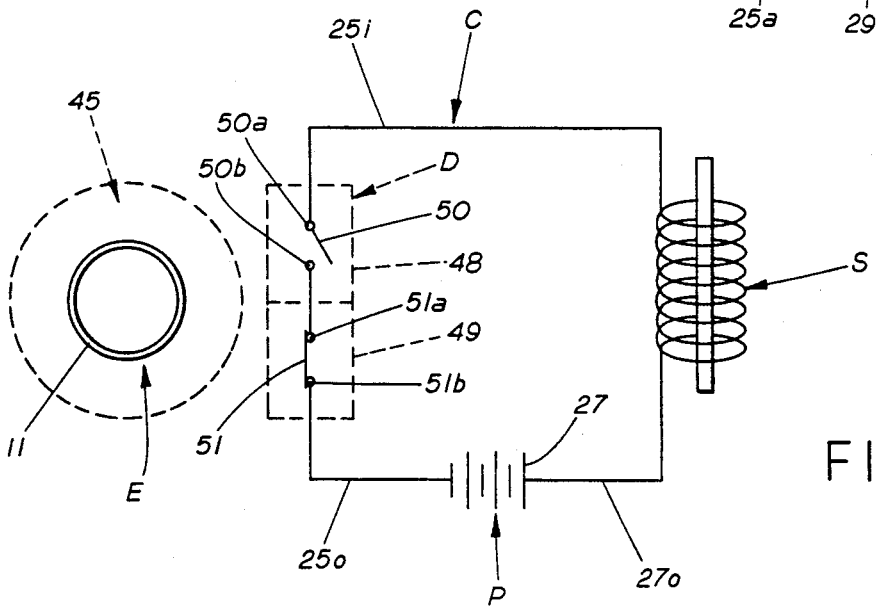
FIG. 2 is an electrical schematic diagram of one embodiment of the encoder-decoder mechanism.

Typically, the decoder means (D) will comprise a magnetically actuated switch block (25) for opening or closing the electrical circuit (C). FIG. 2 shows the decoder (D) as comprising a first and second known magnetically actuated switches (48 and 49 respectively). The switches (48 and 49) are electrically connected in series. First switch (48) further includes a magnetically operable arm (50) and terminals (50*a* and 50*b*). FIG. 2 depicts first switch (48) in the normally open position. Similarly, second switch (49) includes a magnetically operable arm (51) and terminals (51*a* and 51*b*). Second switch (49) is shown as being in the normally closed position.

When a magnetic field (45) is moved into the proximity of the decoder (D), a minimum strength or level of the field is required to magnetically operate arm (50) of first switch (48) to close. On the other hand, if the intensity of the magnetic field is too high, the magnetic field strength will activate or operate arm (51) or the second switch (49) to open the circuit. In this manner a desired range of magnetic field strengths can be selected and thus selectively controlling the use of the weapon.

The minimum electrical circuit typically includes the decoder (D), solenoid (S), and a power source or supply (P), with all being connected electrically. Optionally, these three elements are electrically connected by a first wire (25*i*) from the decoder (25) to the solenoid (S), second wire (27*o*) from the solenoid (S) to one polarity side of the power source (P), and a third wire (25*o*) from the other polarity side of the power source (P).

The power supply (P) generally comprises battery (27), an optional battery holder (29) with terminals (29*t*). The choice of the power supply is determined by the type of the solenoid (S) selected in the construction of the present invention. As is shown in FIG. 1, one end of the second wire (27*o*) is connected to a battery holder terminal (29*t*) and one end of the third wire (25*o*) is connect to the second battery terminal (29*t*).

The solenoid (S) is a known type of electrically operated solenoid (31) having an arm or rod (33). Rod (33) is caused to move upon application of an electrical current across the solenoid (31).

The linkage or locking means (L) is more clearly shown in FIG. 1 with reference to a revolver. However, the specific mechanical linkages would be determined by the specific make or model of weapon incorporating the present invention.

Solenoid arm (33) is connected to a lever or connection arm (35). The lever (35) engages push rod (37). A spring (39) extends between lever (35) and a base element (43). Base (43) is a portion of the hollow handle frame (15) of the handle (14). Spring (39) contains rod (37) in its center and provides tension upon lever (35) to return the lever (35) to its normal position. Rod (37) further engages a locking or blocking rod (41).

The locking rod (41) can optionally block the movement of the trigger (19), the hammer (21) or another known element of the firing mechanism (F).

Preferably, the decoder (D), solenoid (S), power supply (P), and linkages (L) are contained within the handle (14) of the weapon (H). FIG. 1 shows these elements contained within the hollow space (17) formed within the handle (14) by the handle frame (15).

The encoder means (E) typically comprises a magnetized ring (11) for wearing on a finger of a hand gripping the weapon. The magnetic information may be conveyed as a single, relatively uniform magnetic field or as some other magnetically coded information similar to that which is coded on a magnetic tape. Some known examples of magnetically encoded information (or encoders in the terms of the present invention) are parking entry cards, credit cards having magnetic strips of the reverse side and certain security identification passes. Another alternative form of the encoder includes a coded micro-circuit or "chip" that may be embedded in a ring or implanted in a person beneath the skin. Considering the desired signal from the encoder (E), one would select a corresponding type of decoder (D) to detect the signal from the encoder (E) showing authorization.

FIG. 1 shows in phantom an alternative embodiment for the present invention used on a revolver-type handgun. The solenoid (S) may be mounted either internally or externally. The linkage means (L) may include rod (33) that engages the cylinder (23) to block the cylinder's rotation. Another advantage of this alternative embodiment is that the linkage means (L) when engaged or blocking the cylinder (23) also prevents the cylinder (23) from being loaded with cartridges.

Yet another alternative embodiment would be with the decoder (D) having a single switch (48). This alternative would likely be considered less safe since any magnet having a field strength above the minimum to actuate the arm (50) would unlock the safety mechanism.

The designer may select the type of solenoid (31) for its desired operating characteristics. For example the solenoid may extend its arm (33) upon application of the electrical current or it may withdraw the arm (33), that is, whether the solenoid actuates or deactuates. By selecting the elements, the present invention can function to disable the weapon when either the battery weakens or power is removed or, alternatively, the safety mechanism can itself be disabled permitting unrestricted use of the weapon.

The foregoing disclosure and description of the invention are illustrative and explanatory thereof, and various changes in the size, shape and materials, as well as in the details of the illustrated construction may be made without departing from the spirit of the invention.

I claim:

1. A safety device for preventing unauthorized firing of a weapon of the type having a trigger and mechanical firing means for firing the weapon, the invention comprising:

a solenoid means for controllably actuating or deactuating upon the application of an electrical signal;

a decoder means mounted with the weapon for detecting an authorization signal from an authorized user and selectively activating the solenoid means upon the signal from the authorized user, such decoder means being electrically connected to at least a power source and to the solenoid means; said decoder means comprises at least one magnetically actuable switch means electrically connected for opening or closing an electrical circuit when actuated by a magnetic field having a desired field strength;

an encoder means for creating the signal indicating that the possessor is authorized to use the weapon; and linkage means connecting the solenoid means and the firing means for controllably enabling or disabling the weapon from being fired upon the desired activation of the solenoid means.

2. The invention of claim 1 wherein the decoder means functions as a switch to controllably complete or open an electrical circuit including at least the power source, the solenoid means and the decoder means.

3. The invention of claim 1 wherein the decoder means comprises two magnetically actuable switch means electrically connected in series for opening or closing an electrical circuit and wherein one switch remains normally closed unless actuated by a magnetic field having a strength above a desired first level and the second switch remains normally open unless actuated by a magnetic field having a strength below a desired second level, whereby the decoder means selectively activates or deactivates the solenoid means upon detecting a magnetic encoder means having a selected range of magnetic field strengths.

4. The invention of claim 1 wherein the decoder means is mountable within the frame of the weapon.

5. The invention of claim 1 wherein the decoder means, the solenoid means and the linkage means are mountable within the frame of the weapon.

6. The invention of claim 1 wherein the encoder means is a magnetic ring for wearing on a finger of a hand gripping the weapon, said ring being operative to create the desired signal detected by the decoder means.

7. The invention of claim 1 wherein the linkage means comprises a member connected to the solenoid means for selectively blocking the revolving cylinder in a revolver-type weapon from revolving during an engaged position, whereby the revolver-type weapon cannot be fired during the state in which the member is engaged.

8. The invention of claim 1 wherein the linkage means comprises a member connected to the solenoid means and disposed in blocking relationship with the trigger to substantially restrict the trigger from being moved.

9. The invention of claim 1 further characterized by the weapon comprising a pistol.

10. A safety device for preventing unauthorized firing of a weapon of the type having a trigger and mechanical firing means for firing the weapon, the invention comprising:

a solenoid means for controllably actuating or deactuating upon the application of an electrical signal;

a decoder means mounted with the weapon for detecting an authorization signal from an authorized user and selectively activating the solenoid means upon the signal from the authorized user, such decoder means being electrically connected to at least a power source and to the solenoid means; said decoder means comprises at lest one magnetically actuable switch means electrically connected for opening or closing an electrical circuit when actuated by a magnetic field having a desired field strength; and linkage means connecting the solenoid means and the firing means for controllably enabling or disabling the weapon from being fired upon the desired activation of the solenoid means.

11. The invention of claim 10 wherein the decoder means functions as a switch to controllably complete or open an electrical circuit including at least the power source, the solenoid means and the decoder means.

12. The invention of claim 10 wherein the decoder means comprises two magnetically actuable switch means electrically connected in series for opening or closing an electrical circuit and wherein one switch remains normally closed unless actuated by a magnetic field having a strength above a desired first level and the second switch remains normally open unless actuated by a magnetic field having a strength below a desired second level, whereby the decoder means selectively activates or deactivates the solenoid means upon detecting a desired range of magnetic field strengths.

13. The invention of claim 10 wherein the decoder means is mountable within the frame of the weapon.

14. The invention of claim 10 wherein the decoder means, the solenoid means and the linkage means are mountable within the frame of the weapon.

15. The invention of claim 10 further including an encoder means for creating the signal indicating that the possessor is authorized to use the weapon.

16. The invention of claim 15 wherein the encoder means is a magnetic ring for wearing on a finger of a hand gripping the weapon, said ring being operative to create the desired signal detected by the decoder means.

17. The invention of claim 10 wherein the linkage means comprises a member connected to the solenoid means for selectively blocking the revolving cylinder in a revolver-type weapon from revolving during an engaged position, whereby the revolver-type weapon cannot be fired during the state in which the member is engaged.

18. The invention of claim 10 wherein the linkage means comprises a member connected to the solenoid means and disposed in blocking relationship with the trigger to substantially restrict the trigger from being moved.

19. The invention of claim 10 further characterized by the weapon comprising a pistol.

20. A safe firing weapon comprising:

a weapon further including a trigger and mechanical firing means for firing the weapon;

a solenoid means for controllably actuating or deactuating upon the application of an electrical signal;

a decoder means mounted with the weapon for detecting an authorization signal from an authorized user and selectively activating the solenoid means upon the signal from the authorized user, such decoder means being electrically connected to at least a power source and to the solenoid means; said decoder means comprises at least one magnetically actuable switch means electrically connected for opening or closing an electrical circuit when actuated by a magnetic field having a desired field strength; and linkage means connecting the solenoid means and the firing means for controllably enabling or disabling the weapon from being fired upon the desired activation of the solenoid means.

21. The invention of claim 20 wherein the decoder means functions as a switch to controllably complete or open an electrical circuit including at least the power source, the solenoid means and the decoder means.

22. The invention of claim 20 wherein the decoder means comprises two magnetically actuable switch means electrically connected in series for opening or closing an electrical circuit and wherein one switch remains normally closed unless actuated by a magnetic field having a strength above a desired first level and the second switch remains normally open unless actuated by a magnetic field having a strength below a desired second level, whereby the decoder means selectively activates or deactivates the solenoid means upon detecting a desired range of magnetic field strengths.

23. The invention of claim 20 wherein the decoder means is mountable within the frame of the weapon.

24. The invention of claim 20 wherein the decoder means, the solenoid means and the linkage means are mountable within the frame of the weapon.

25. The invention of claim 20 further including an encoder means for creating the signal indicating that the possessor is authorized to use the weapon.

26. The invention of claim 25 wherein the encoder means is a magnetic ring for wearing on a finger of a hand gripping the weapon, said ring being operative to create the desired signal detected by the decoder means.

27. The invention of claim 20 wherein the linkage means comprises a member connected to the solenoid means for selectively blocking the revolving cylinder in a revolver-type weapon from revolving during an engaged position, whereby the revolver-type weapon cannot be fired during the state in which the member is engaged.

28. The invention of claim 20 wherein the linkage means comprises a member connected to the solenoid means and disposed in blocking relationship with the trigger to substantially restrict the trigger from being moved.

29. The invention of claim 20 further characterized by the weapon comprising a pistol.

* * * * *